United States Patent [19]

French

[11] 4,115,952

[45] Sep. 26, 1978

[54] SAFETY DOOR EDGE

[75] Inventor: Harlan S. French, Phillipsburg, N.J.

[73] Assignee: American Can Company, Greenwich, Conn.

[21] Appl. No.: 773,496

[22] Filed: Mar. 2, 1977

[51] Int. Cl.[2] ..... E05F 15/02

[52] U.S. Cl. ..... 49/26; 200/61.43

[58] Field of Search ..... 49/26–28; 200/61.43

[56] References Cited

U.S. PATENT DOCUMENTS

| | | | |
|---|---|---|---|
| 3,118,984 | 1/1964 | Koenig | 200/61.43 |
| 3,154,303 | 10/1964 | Cavallero et al. | 49/27 X |
| 3,754,176 | 8/1973 | Miller | 200/61.43 X |

*Primary Examiner*—Kenneth Downey

*Attorney, Agent, or Firm*—Robert P. Auber; Ira S. Dorman; Douglas W. Wyatt

[57] ABSTRACT

A door has a flexible channel along its free edge which flexes upon striking an obstruction and brings together two conductive ribbons within the channel. The ribbons are part of an active circuit which includes a relay coil. Temporary contact of the two conductive ribbons resulting from contact with the obstruction de-energizes the relay coil, fully opening the door. Since door opening results from de-energizing a coil, a power or circuit failure will also cause the door to open.

4 Claims, 4 Drawing Figures

SAFETY DOOR EDGE

BACKGROUND OF THE INVENTION

The present invention relates to door safety devices and more particularly to a safety system in which the door is automatically opened when it strikes an obstruction while being closed.

At the present time the use of safety edge devices on doors, to prevent the door from being closed when it meets an obstruction, is well known, particularly in the doors of automatic elevators. For example, if an elevator door should hit or approach a passenger in its doorway, the elevator door will automatically open.

Various types of systems have been suggested to control such doors. For example, a series of light beams and a series of photoelectric detectors, i.e., "electric eyes," may be used between the door and the door frame. When one of the beams is interrupted, a controlled motor operates and opens the door. Alternatively, the door edge may carry an elongated flexible gas filled bag so that, when the edge strikes an obstruction, the gas pressure rises and operates a motor control mechanism. As another alternative, various types of pressure sensitive electrical switches, such as microswitches, may be used in the door edge. The switches may directly, or indirectly through an amplifying circuit, control a motor which opens the door.

It would be desirable to use a door safety system in other types of doors, particularly in a factory environment. For example, an increased interest has developed in noise control within factories. This has resulted in an increased use of enclosures for noisy machines. Such enclosures require various types of "doors," as that term is used herein, such as vertical sliding portals, horizontal swinging portals, movable hoods and movable windows. These "doors" may be dangerous if closed upon an obstruction, such as a tool or a worker's hand.

However, the door safety systems currently in use present various difficulties, particularly if employed in a factory environment. Certain of those door safety systems are not "fail safe," that is, they will not provide protection if one, or more, of their components should fail. For example, in the case of a direct contact microswitch, the switch contacts may become corroded and fail to make electrical contact when the door hits an obstruction. Other proposed safety door edge systems may be too delicate or complicated for use in factory safety systems.

SUMMARY OF THE INVENTION

In accordance with the present invention, a safety system for a door is provided. The system includes an elongated flexible channel member secured to the free edge of the door. Two normally separated conductive ribbons are positioned within the flexible channel member. When the flexible channel member is compressed by an obstruction, the compressive force is transmitted to the ribbons through a flexible diaphragm and ribs within the channel member. The compressive force brings the ribbons into electrical contact.

The ribbons are part of an active circuit, which active circuit also includes a power source such as a power transformer, a thermal switch, a resistor and an electromagnetic relay having a coil, a spring-loaded moving member (an arm) and electrical contacts.

In operation, the transformer supplies power to the relay coil which energizes a control circuit by pulling the moving member into a closed position. Upon compression of the door channel member, the ribbons touch and shunt the relay coil, causing the moving member to open the control circuit. The control circuit has a solenoid which, when de-energized, causes an air cylinder to open the door. The resistor in the active circuit prevents shorting of the circuit should the ribbons remain in contact. The thermal switch, such as a bimetal lever switch, senses the temperature of the resistor and opens the active circuit when the resistor temperature rises and reaches a selected temperature, thereby preventing over-heating of the resistor.

If any components of the active circuit should fail, or if the power to the active circuit should fail, the power to the relay coil will be lost, allowing the moving member to open the control circuit and de-energize the solenoid causing the door to be opened by the air cylinder. The air cylinder is operated by compressed air stored in a supply tank. The system of the present invention, consequently, presents a "fail safe" system which will open the door upon component or power failure.

OBJECTIVES AND FEATURES OF THE INVENTION

It is an objective of the present invention to provide a safety system for a door edge, which safety system, upon the edge striking an obstruction, will initiate automatic opening of the door.

It is a further objective of the present invention to provide such a safety system which will operate to open the door even though one or more components of its electrical circuit should fail.

It is a further objective of the present invention to provide such a safety system for a door edge which, if the power to its electrical system should fail, will still initiate the automatic opening of the door.

It is a further objective of the present invention to provide such a safety edge which utilizes relatively few components so that it may be relatively readily repaired and may be produced at a relatively low cost.

It is a further objective of the present invention to provide such a safety edge which is especially adapted to be used connected at the edge of the sliding doors of noise enclosures.

It is a feature of the present invention to provide a door safety closing system. The system includes a door frame, a door movably mounted in the door frame and movable into an open and closed position, control means for operating an air cylinder, and an air cylinder to open and close the door upon receiving a control signal from the air cylinder control means. The door has a free edge which is movable against the door frame in the closed position. When the free edge strikes an obstruction, the air cylinder opens the door.

The system also includes an active circuit connected to the air cylinder control means and including a pair of conductive ribbons. Each of the ribbons has a first and a second terminal separated by a length of ribbon. The active circuit also comprises a power source means to provide power to the active circuit and relay means having a coil, contacts, and a movable relay arm which opens and closes the contacts. The relay arm is in closed position energizing the solenoid when the relay is energized. When the solenoid is energized, the door is moved to the closed position. When the relay is de-energized, the relay opens the control circuit and de-energizes the solenoid. When the solenoid is de-energized, the air cylinder moves the door to the open position.

The door has a safety edge means attached to it which provides an electrical change when the safety edge strikes against an obstruction during closing motion of said door. The safety edge means includes the pair of electrically conductive ribbons. The ribbons are normally separated and contact each other when the safety edge strikes an obstruction, the contact of the ribbons shorting the relay coil.

It is a further feature of the present invention that the safety edge means includes an elongated flexible channel member having an open side, an outer wall and an interior cavity. The channel member has its open side attached to the free edge of the door. A diaphragm is attached to the flexible member within said cavity and a plurality of ribs within the cavity extends from the diaphragm to the flexible channel member and moves the diaphragm when the channel member strikes an obstruction. The two conductive ribbons are positioned within the cavity and on the opposite side of the diaphragm from the ribs, so that movement of the diaphragm brings the ribbons into contact and shorts the relay coil.

BRIEF DESCRIPTION OF THE DRAWINGS

Other objectives and features of the present invention may be ascertained from the detailed description provided below, which gives the inventor's best presently known mode of practicing the invention. The detailed description should be taken in conjunction with the accompanying drawings, in which.

DETAILED DESCRIPTION OF THE PREFERRED EMBODIMENT

Figure 1:
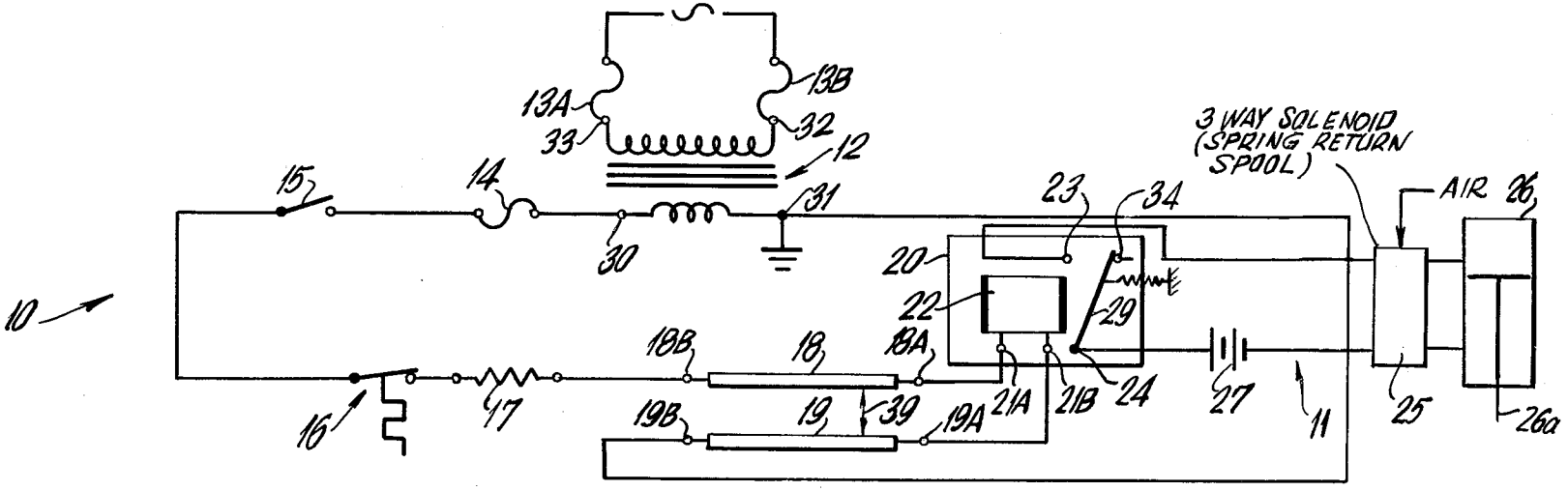
FIG. 1 is a schematic diagram of an electrical circuit which is part of the safety system of the present invention.

FIG. 1, in accordance with the present invention, shows two electrical circuits — a safety circuit 10 for sensing door obstructions and a solenoid operated air cylinder circuit 11 for raising the door 9 (FIGS. 3 and 4) upon contact with an obstruction.

Circuit 10 uses a magnetic core power transformer 12 for its input voltage supply; for example, it receives 110 volts at its primary and produces 24 volts at its secondary windings. Terminals 33 and 32 of the primary winding of transformer 12 are connected to external power through fuses 13A and 13B, respectively. Output terminal 30 of the secondary winding of transformer 12 is connected in series with a fuse 14, an override switch 15, a thermal switch 16, a resistor 17, and the second terminal 18B of a conductive ribbon 18.

The first terminal 18A of the conductive ribbon 18 is connected to terminal 21A of the coil 22 of an electromagnetic relay 20. Terminal 21B of the coil 22 of relay 20 is connected to the first terminal 19A of the conductive ribbon 19. The opposite and second terminal 19B of ribbon 19 is connected to grounded terminal 31 of transformer 12, thus completing safety circuit 10. The relay 20 has a controlled arm 29 as its movable element.

Resistor 17 of safety circuit 10 has a resistance value equal to, preferably, about 10% of the coil resistance in the coil of relay 20. This resistance value difference allows the relay coil 22 to receive the full circuit voltage without a large voltage drop across the resistor 17. Shorting of the ribbons 18,19 by contacting one ribbon with the other causes the circuit relay 20 to be shunted out of the circuit 10. The coil of the relay 20 is thus placed in a de-energized state. The resistor 17 of circuit 10 then picks up the shunted voltage, preventing a short circuit. The resistance of resistor 17 should be in the range of about 5–20% of the resistance of the relay coil, and preferably about 10% of that resistance. To prevent over-heating of the resistor 17 due to extended shorting or shunting of the coil 22 of the relay 20, the thermal switch 16 in safety circuit 10 will detect an over-heating of the resistor 17 and open, removing power from the resistor 17 and safety circuit 10. This feature is necessary to allow the use of a resistor 17 with a circuit handling (wattage) value within the switching capability of the ribbon switch (ribbons 18 and 19).

The solenoid operated air cylinder of the control circuit 11 of FIG. 1, for raising door 9 (FIGS. 3,4) upon contact with an obstruction, is comprised of a power source 27, shown as a d.c. battery, and a three-way solenoid 25 connected to the controlled switch contacts (terminals 23 and 24) of the relay 20.

The three-way solenoid 25 directs air to an air cylinder 26 which has an air piston **26*a* disposed therein. When the solenoid 25 is de-energized, a spring-loaded spool in the solenoid causes compressed air entering the solenoid to be directed to one side of the air cylinder 26, causing the door 9 to be moved to the open position. When the solenoid 25 is energized, the spool in the solenoid shifts and directs air to the opposite side of the air cylinder, causing the door to move to the closed position. When the relay 22 is de-energized because of ribbon contact due to an obstruction, or if the relay 22 is de-energized due to power failure, the spring-biased relay arm moves to the open position, thereby de-energizing the solenoid and causing the door to move to the open position. The unconnected terminal 34 of the relay 20 may be connected in series with a light and/or other status indication device to the terminals of power source 27**.

Figure 2:
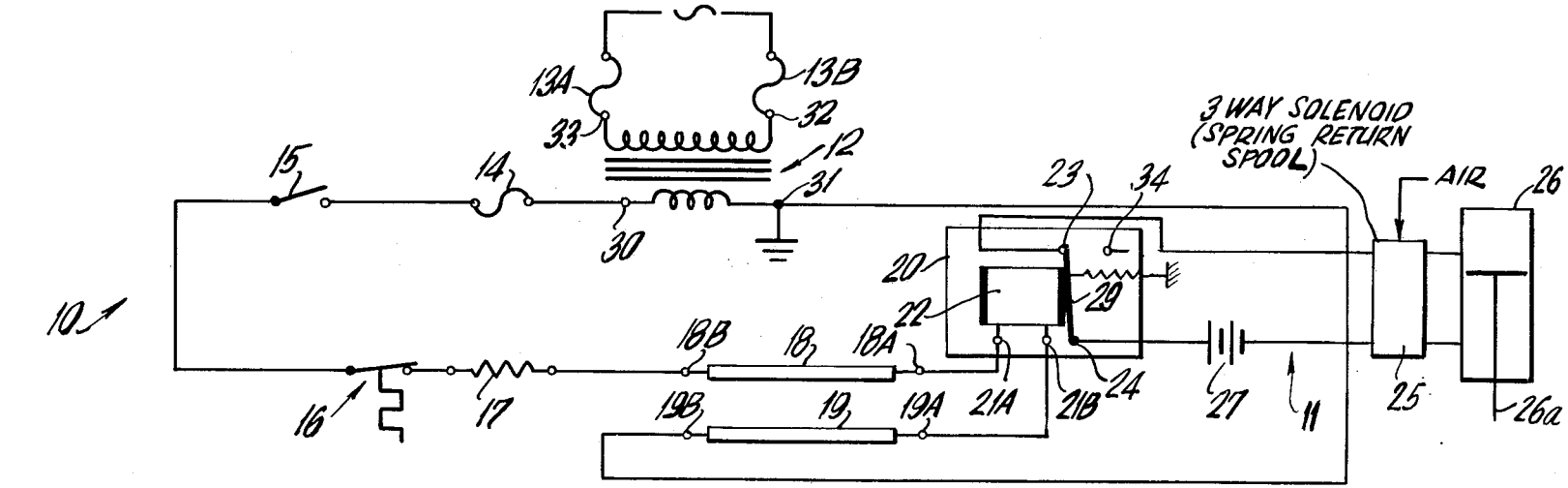
FIG. 2 is a schematic diagram of the same electrical circuit as in FIG. 1 but showing its relay with its contacts in the closed position.

FIG. 2 shows the same safety circuit 10 and air cylinder control circuit 11 as shown in FIG. 1, but with the controlled arm (movable element) 29 of relay 20 held in a closed position against relay coil 22. In other words, the relay coil is activated and the switch terminals 23,24 are closed.

Figure 3:
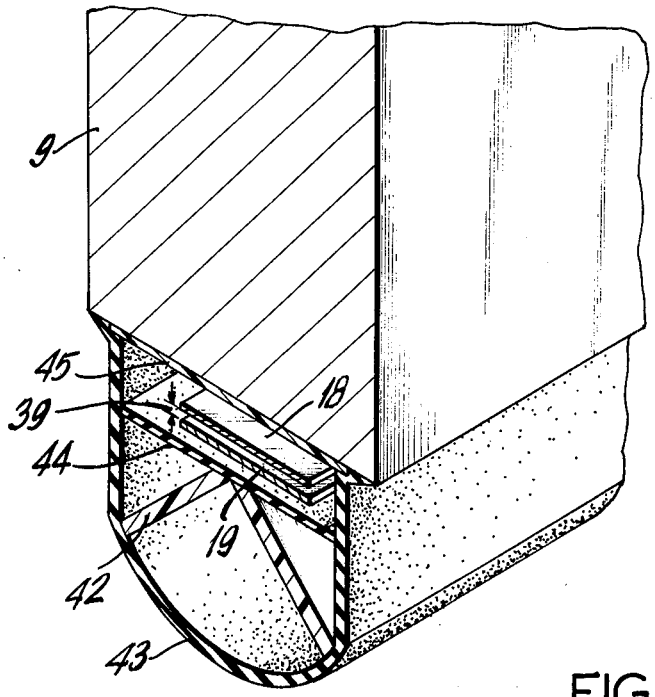
FIG. 3, a perspective view partly in cross-section, is a representation of a mechanical implementation of the safety system of the present invention in a door edge.

FIG. 3 depicts one embodiment of a mechanical implementation utilizing the circuits of FIGS. 1 and 2, which is a perspective view partly in cross-section. The door 9 has as an end projection a flexible and resilient channel member 43, for example, of rubber or synthetic rubber. The open side of channel member 43 is mounted on the free side of the door 9, the free side being the bottom edge in a downwardly closable, vertically slidable door. The flexible channel member 43 is held semi-rigid through the plastic ribs 42 which are attached to a flexible, resilient and movable diaphragm 44. The normally open ribbon switch, comprised of the ribbons 18 and 19, is enclosed within the flexible channel member 43 and positioned between the diaphragm 44 and the edge of the door 9. The ribbons 18 and 19 are separated, for example, 0.015 inch, by either (i) spring-loaded tension along their length, i.e., between their respective first terminals 18A, 19A and the second terminals 18B, 19B; and/or (ii) thin foam washers of a minimal thickness. The minimal spacing 39 is elastic such that the ribbons 18 and 19 may be brought into contact through application of pressure, but will revert to their original position once the pressure is released.

In operation, when the free door edge meets an obstruction, such as a worker's hand or a tool left in the door frame, the flexible channel 43, when it encounters the obstruction, will bend, causing the ribs 42 to push the diaphragm 44 inwardly toward the free edge of the door 9. The inward pressure of diaphragm 44 will cause the ribbons 18 and 19 to contact, thereby shunting relay 20 and thus de-energizing the relay coil 22. The de-energization of the relay coil 22 allows the spring-biased relay arm 29 to move from terminal 23 to terminal 34. This will de-activate air cylinder control circuit 11, de-energizing solenoid 25, causing the air to drive the piston to open the door. However, once door edge 43 has cleared the obstruction, the ribbons 18 and 19 are no longer in contact and the relay 20 is no longer shunted. The relay 20 is again energized; however, a latching circuit prevents the solenoid 25 from being re-energized and closing the door again. A relatching switch must be actuated to again re-energize the solenoid 25 and allow the door to reclose.

The particular fail safe characteristic of the circuit is that, upon de-energizing the solenoid, the door will open. Thus, (i) plant electric power failure, (ii) electrical component failure, (iii) opening of override switch 15, or (iv) safety edge contact with an obstruction, will cause door 9 to open. In situations 1 to 3 the door will be opened until the failure is corrected, i.e., the replacement of the component, the restoring of power, or the closing of the switch 15. There is no danger of door damage as door opening is accomplished through an air driven piston which stops as the door reaches its fully open position. An adequate air supply is maintained to open the door, even though there may be an electrical power failure.

Figure 4:
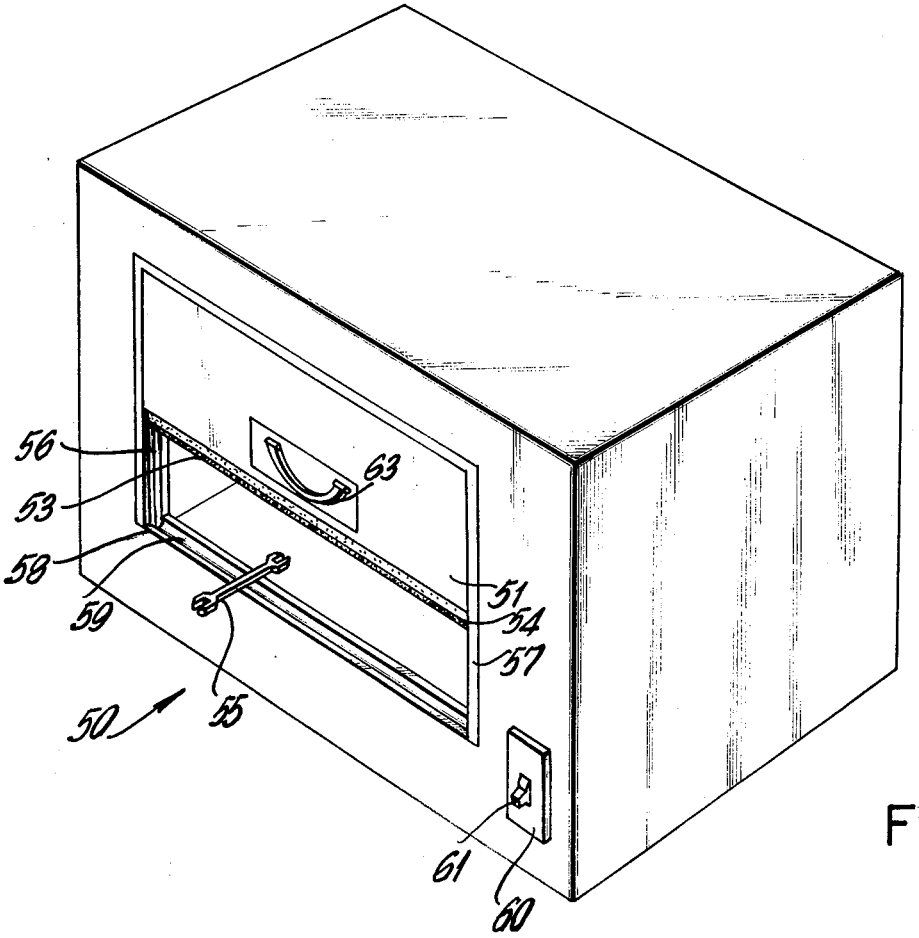
FIG. 4 is a perspective view of a noise and safety enclosure which is a representation of one embodiment of the present invention, the enclosure including a vertically slidable door.

FIG. 4 depicts one embodiment of the mechanical implementation of the system of the present invention as applied to a machine enclosure 50. The interior walls of the enclosure 50 are padded with sound-absorbing material. The enclosure acoustically isolates a machine, located therein, from the plant when its door 51 is closed. The door 51 may be operated either vertically as shown in FIG. 4, or laterally (not shown).

The door 51 has a handle 63, which may be either recessed or surface mounted, a safety edge 53 consisting of a flexible channel attached on its open side to the free side 54 of door 51 and a sound insulated perimeter 57 sufficient to cause the enclosure 50 to be acoustically isolated upon closing of the door 51. The door 51 is vertically slidable in track 56 and closes against jamb 58. The jamb 58 has a safety edge recess 59 which accepts safety edge 53 so that the door 51 may close without compression of the safety edge 53.

A control box 60 containing a door operation switch 61 is located on the exterior of the enclosure 50. FIG. 4 also shows an obstruction 55, placed across the jamb 58 and the safety edge recess 59.

The operation of the preferred and described embodiment of the present invention is as follows: As a result of the obstruction across the jamb 58 and the safety edge recess 59, the door 51 may not be closed but rather is automatically opened. Upon contact with the obstruction the safety edge 53 compresses. As shown in FIG. 3, an inward force is transmitted to the diaphragm 44 through the ribs 42. The diaphragm 44 flexes inwardly, forcing the ribbons 18 and 19, which are normally separated by minimal spacers 39, to come into contact. The contact of ribbons 18,19 shunts relay 20. This causes the coil 22 of the relay 20 to become de-energized, thus allowing controlled switch terminals 23,24 to assume their open position.

The resistor 17 provides a voltage drop path for the shunted voltage, upon closure of the ribbons 18,19, so that the safety circuit 10 is not short-circuited. When the resistor 17 becomes heated, the thermal switch 16 opens, removing power from the resistor 17 — if the ribbons 18,19 remain in contact for a period of time.

Once the door 9 has cleared the obstruction, the channel member 43 is no longer compressed and is no longer exerting an inward pressure on the diaphragm 44 through ribs 42. The ribbons 18 and 19 are no longer under pressure and will revert to their original spacing, thus removing the shunt to the relay 20. The coil 22 is energized, causing the controlled switch arm to contact terminal 23, closing the circuit 11. However, the latching circuit (not shown) prevents the solenoid 25 from being re-energized and reclosing the door. A relatching switch must be actuated to re-energize the solenoid 25.

The term "door" as used herein is intended broadly to cover various types of portals such as horizontal or vertical slidable hoods.

What is claimed is:

1. A fail-safe door safety closing system including a door frame, a door movably mounted in said door frame and movable into an open and a closed position, a control means to generate a control signal, a door operating means having an independent first power source to open said door upon receiving a control signal from said control means, said door having a safety edge means which is movable against said door frame in said closed position, said edge means including first and second conductive ribbon means, each of said ribbon means having first and second terminals separated by a length of conductive ribbon, said ribbons being normally separated and contacting each other upon an edge striking an obstruction, an active circuit comprising second power source means to provide electrical power to said active circuit and a relay means having a coil with first and second terminals, relay contacts and a movable member which closes said relay contacts when the relay is energized and opens said relay contacts when the relay is de-energized, the first relay terminal being connected to the first terminal of the first ribbon means and the second relay terminal being connected to the first terminal of the second ribbon means, said second terminals of both said ribbon means being connected in series with said second power source, said relay contacts when closed operating said control means and starting the operation of said door operating means to close the door, said contacts when open de-energizing said control means so that said door operating means opens said door, wherein said relay coil is shorted by the contacting of said ribbons and said relay is de-energized upon failure of the active circuit, thereby opening said door upon active circuit failure.

2. A door safety system as described in claim 1 wherein said safety edge means comprises a flexible channel member mounted on the edge of said door containing interiorly a hollow channel, said first conductive ribbon and said second conductive ribbon passing into and mounted on the interior walls of said hollow channel, said first conductive ribbon being brought into contact with said first conductive ribbon when said flexible channel member is deformed as said edge means encounters an obstruction, said door frame having a groove shaped so as to receive said edge means without deformation when said door is in its closed position, so that said flexible channel member will not be compressed opening said door.

3. The door safety closing system as described in claim 1, wherein said control means comprises a solenoid and wherein said door operating means comprises an air cylinder connected to a source of compressed air, the delivery of said air to said air cylinder being controlled by said solenoid.

4. The door safety closing system as described in claim 3 wherein said solenoid has a spring-biased spool and wherein said solenoid directs compressed air from said source to one side of said air cylinder for opening the door when said solenoid is de-energized, wherein when said solenoid is energized the spool is shifted to direct air to the other end of the air cylinder, causing said door to close.

* * * * *